US007384273B1

(12) United States Patent
Polnyi

(10) Patent No.: US 7,384,273 B1
(45) Date of Patent: Jun. 10, 2008

(54) ELECTRICAL CONNECTOR ASSEMBLY

(75) Inventor: Igor Polnyi, Aurora, IL (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/648,476

(22) Filed: Dec. 28, 2006

(51) Int. Cl.
*H01R 12/00* (2006.01)

(52) U.S. Cl. ..... 439/71; 439/526

(58) Field of Classification Search ..... 439/71, 439/526, 70, 525
See application file for complete search history.

(56) References Cited

U.S. PATENT DOCUMENTS 4,144,648 A * 3/1979 Grovender ..... 439/331
4,351,580 A * 9/1982 Kirkman et al. ..... 439/71
5,022,869 A * 6/1991 Walker ..... 439/526
5,155,905 A * 10/1992 Miller, Jr. ..... 29/843
5,329,227 A * 7/1994 Sinclair ..... 324/158.1
5,653,600 A * 8/1997 Ollivier ..... 439/73
5,885,101 A * 3/1999 Matsuoka et al. ..... 439/526
6,679,707 B1 * 1/2004 Brodsky et al. ..... 439/71
6,881,073 B2 * 4/2005 Bali et al. ..... 439/70
6,923,658 B2 * 8/2005 Cromwell et al. ..... 439/71
7,037,116 B1 * 5/2006 Liao et al. ..... 439/71
7,056,130 B1 * 6/2006 McAlonis et al. ..... 439/71
7,059,869 B2 * 6/2006 Wertz et al. ..... 439/71
2002/0132520 A1 * 9/2002 Takahashi ..... 439/526
2005/0090126 A1 * 4/2005 Achammer et al. ..... 439/71
2006/0094266 A1 * 5/2006 Liao et al. ..... 439/71

* cited by examiner

*Primary Examiner*—Gary F. Paumen
(74) *Attorney, Agent, or Firm*—Wei Te Chung

(57) ABSTRACT

An electrical connector assembly comprise a chip module (2) formed a number of protrusions (21) extending outwardly from sidewalls thereof, a bracket (1) comprising a number of receiving sections (11), a number of housings (4) each having a plurality of terminals (5) assembled therein and received in the corresponding receiving section respectively, and each housing (4) disposed a number of supporting members (3) corresponding to the protrusions (21) for interferingly engaging with the protrusions (21) to supporting the chip module (2) thereon.

11 Claims, 3 Drawing Sheets

ELECTRICAL CONNECTOR ASSEMBLY

BACKGROUND OF THE INVENTION

1. Field of the Invention

The present invention relates to electrical connector assemblies, and more particularly to an electrical connector assembly able to provide a good engagement between a chip module and an electrical connector therein 2. The Background of the Invention Connectors for removably mounting a chip module on a PCB are known as electrical connectors. A typical electrical connector includes an insulative housing, a multiplicity of terminals received in the housing in a rectangular array.

An electrical connector includes an insulative housing, a number of terminals, a chip module received in the housing. The housing defines a number of passageways for receiving the terminals therein. Generally, the chip module is configured as a rectangular shape and the housing defines a cavity for receiving the chip module therein, and the chip module is usually engaged with housing with the whole outer sidewalls abutting against inner sidewalls of the housing, wherein the engagement between the housing and the chip module is usually interference fit. So the geometry of the chip module is demanded rigidly and the tolerance between the housing and the chip module is hard to control, especially the tolerance thereof after bake process, in addition, the chip module is figured to a normal rectangular shape with coplanar sidewall surface so that when the tolerance of the chip module needed to amend, the whole sidewalls of the chip module need to be grinded thereby the cost paid on it higher and the time taken on it more.

What needed, therefore, is an improved electrical connector assembly able to provide a simplified engagement between the electrical connector and the chip module.

SUMMARY OF THE INVENTION

The present invention provides an electrical connector assembly includes an number of insulative housings each with a plurality of electrical terminals received therein, a bracket having a receiving cavity in a middle portion thereof for partially receiving the housing therein and a number of supporting members attached on the corners of the housing for engaging supportable with chip module. Each insulative house is generally L-shaped, which defines a number of passageways therein for receiving the terminals therein. The chip module is configured as rectangular shape with corresponding numbers of projected portions on sidewalls thereof for engaging with supporting members to attach the chip module on the housing. The projected members of the chip module can solve the problem to hold the chip module tolerance after bake and decrease the cost for grinding the engaging edges of the chip module for required tolerance.

Other advantages and novel features will become more apparent from the following detailed description of the preferred embodiment of the present invention when taken in conjunction with the accompanying drawings.

DESCRIPTION OF THE PREFERRED EMBODIMENT OF THE INVENTION

Reference will now be made to the drawings to describe of a preferred embodiment of the present invention in detail.

Figure 1:
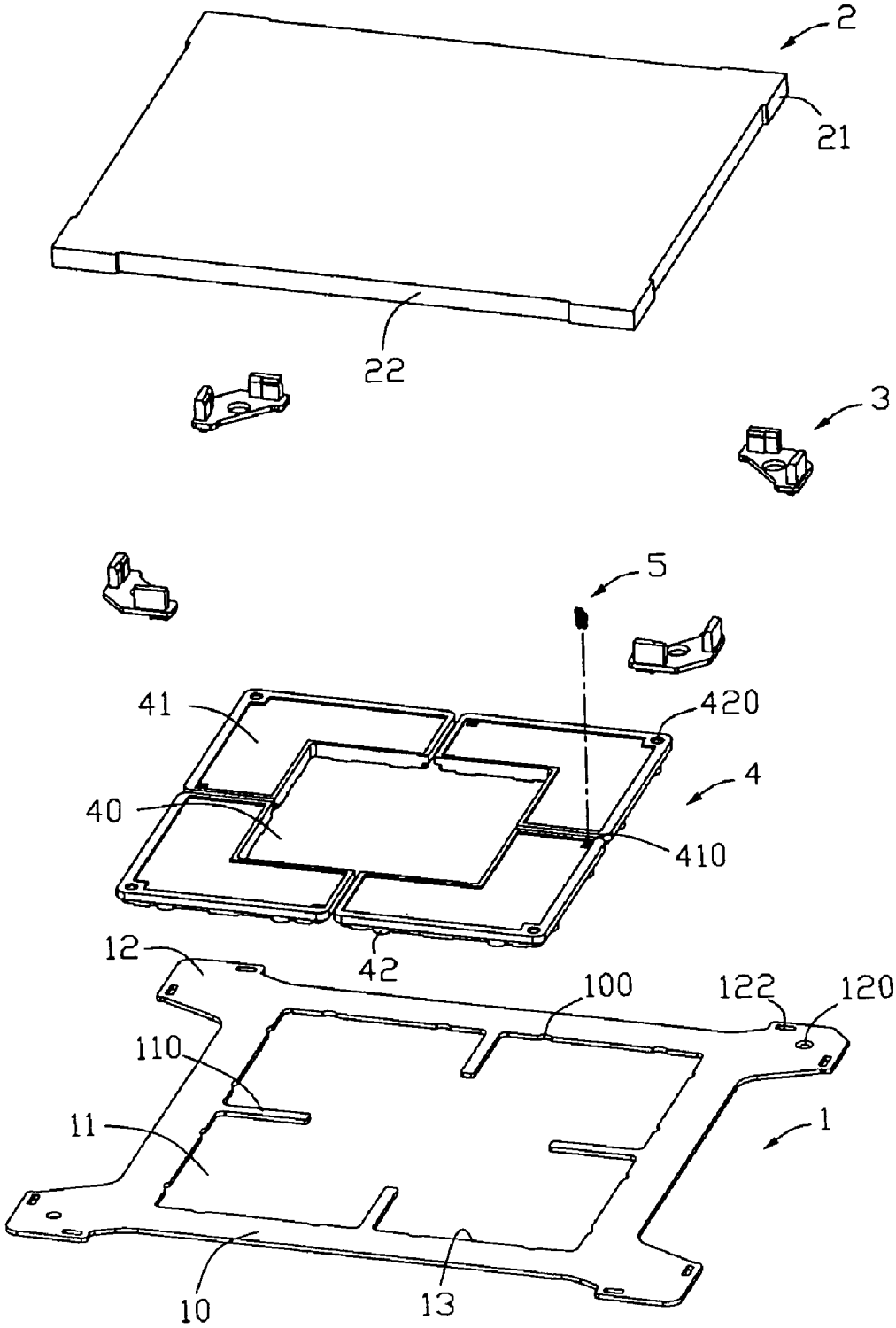
FIG. 1 is an exploded, isometric view of an electrical connector assembly of an preferred embodiment of the present invention.
Figure 2:
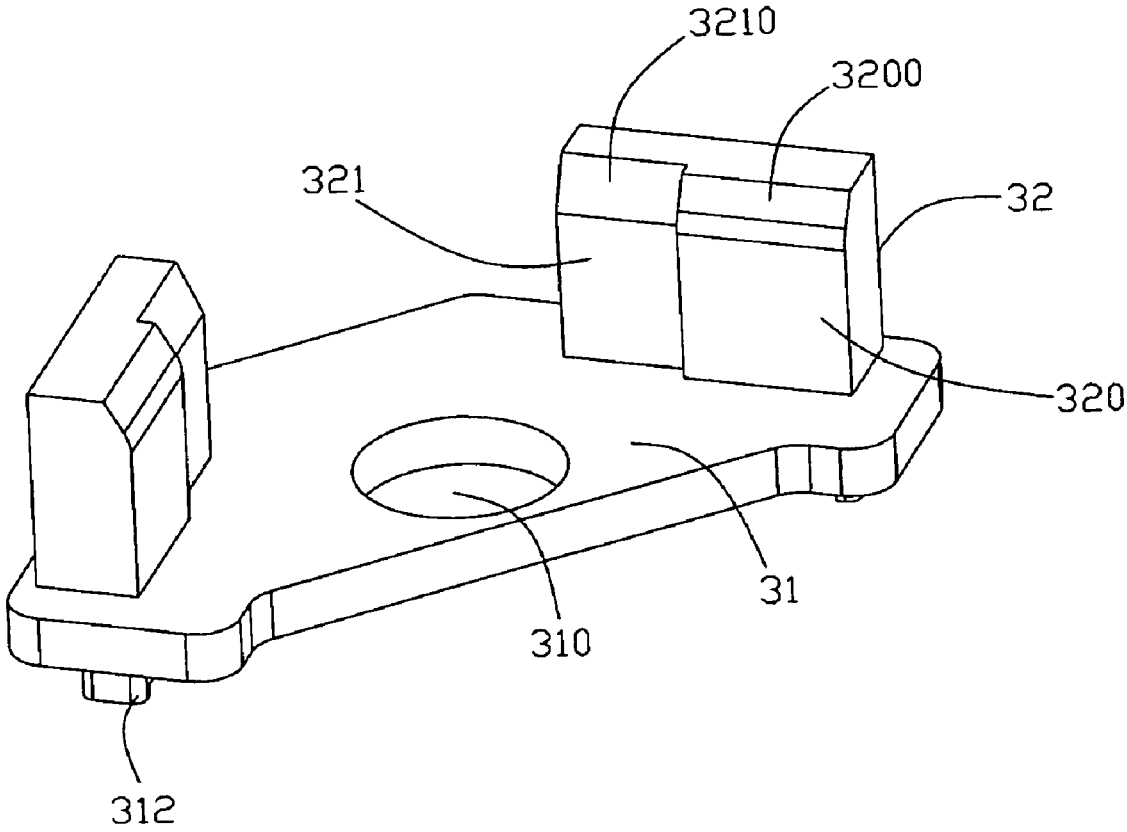
FIG. 2 is an enlarged view of the supporting member of FIG. 1.
Figure 3:
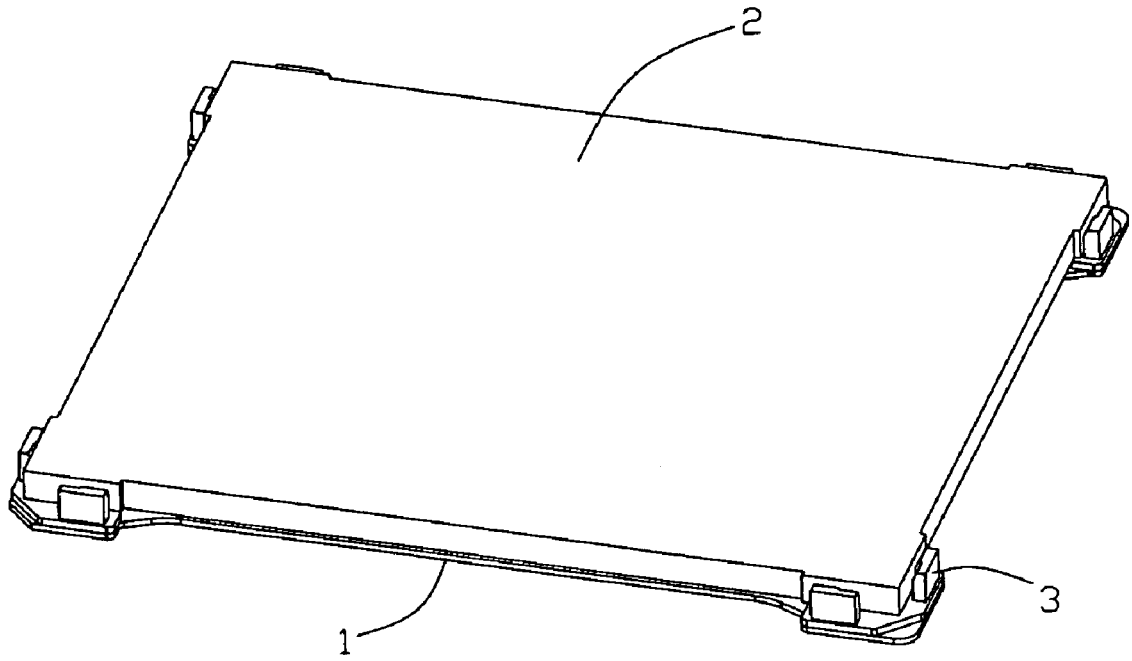
FIG. 3 is an assembled view of the electrical connector assembly of FIG. 1.

Referring to FIG. 1 to FIG. 3, an electrical connector assembly in accordance with a preferred embodiment of the present invention is adapted for electrically connecting a chip module 2 with a circuit substrate such as a printed circuit board (PCB) (not shown). The connector assembly includes four generally rectangular insulative housings 4, a plurality of electrical terminals 5 received in each housing 4, a metal bracket 1 partially surrounding the housings 4 to enforce the housings 4, the chip module 2 mounted on a top surface formed cooperatively by the housings 4.

Each housing 4 includes an L-shaped main body 41, a positioning hole 410 defined on the corner thereof. The main bodies 41 of the housings 4 together form a supporting surface for holding a CPU thereon. The main body 41 defines a multiplicity of passageways 410 arranged in a rectangular array for receiving a corresponding number of terminals 5 therein. Each housing 4 further defines a number of protrusions 42 for interferingly engaging with the bracket 1.

The bracket 1 has a bottom portion 10 which defines a cavity 11 in the middle thereof, and four elongated members 110 each extending inwardly from a center position of inner walls of bracket 1 for separating the cavity 11 into four receiving sections for receiving the corresponding housings 4 therein. The bottom portion 10 further extends four extending portions 12 from corners thereof, each extending portion 12 defines a hole 120 in communication with the positioning hole 420 of the corresponding housing 4 accommodated thereon and a pair of channels 122 arranged two sides of the hole 120 for engaging with the supporting member 3. The inner walls of the bracket 1 define a number recess 100 corresponding to the protrusions 42 of the housing for getting an interfering engagement between the housing 4 and the bracket 1.

The chip module 2 is configured to a rectangular shape with a number of protrusions 21 extending from corners therein for interferingly engaging with the supporting members, in the embodiment, the protrusions 21 one the sidewalls interconnect each other, the protrusions disposed for engaging with other components can decrease the surface need to be grinded.

The supporting member 3 is configured as irregular shape, and comprises a body portion 31 with a plate-like shape, a pair of engaging portions 32 extending upwardly from a top surface of the body portion 31 and arranged opposite to each other, and a pair of inserting member 312 extending from a lower surface of the body portion 31 for inserting into the corresponding channels 122 of the bracket 1. The engaging portion 32 defines a concave portion 321 and a projected portion 320 adjacent the concave portion 321 for engaging with the protrusions 21 of the chip module, and the concave portion 321 and the projected portion 320 each define a slant surface 3210, 3200 on a top end thereof for convenience the mounting of the chip module 2.

Referring to FIG. 1 and FIG. 3, in assembly, When the housings 4 received terminals 5 is pushed into the cavity 11 of the bracket 1, with the projected portions 42 interferingly engaging with the recesses 100 of the bracket 1 and the surrounding wall 21 interferingly abutting against inner side of the bottom portion 30. Then the four support members 3 are located on the corresponding corners of the bracket 1 with the inserting portion 312 inserted into the channels 122 of the bracket 1, successively by fastening members (not shown) passing through the holes of the supporting members, the positioning holes 420 and holes 120 of the extending portion 12 locating the supporting member 3 onto the bracket 1. At last, the chip module 2 is mounted on the upper surface of the housings 2 with the protrusions 21 of the chip module engaging with the projected portions 320 of the supporting member 3.

Due to that the chip module 2 has four corner protrusions 21 protruding outwardly from the four corners respectively so that the chip module 2 can be accurately positioned in a predetermined place and solve the problem to hold the chip module tolerance after bake and decrease the cost for grinding the whole engaging edges of the chip module 2 for required tolerance.

Although the present invention has been described with reference to a particular embodiment, it is not to be construed as being limited thereto. Various alterations and modifications can be made to the embodiment without in any way departing from the scope or spirit of the present invention as defined in the appended claims. The above embodiment illustrates the scope of the invention but do not restrict the scope of the invention.

What is claimed is:

1. An electrical connector assembly, comprising:

a chip module formed with a number of protrusions extending outwardly from sidewalls thereof;

a bracket comprising a number of receiving sections;

a number of housings each having a plurality of terminals assembled therein and received in the corresponding receiving section respectively, and each housing provided with a discrete supporting member corresponding to the respective protrusion for interferingly engaging with the respective protrusion to support the chip module thereon.

2. The electrical connector assembly as claimed in claim 1, wherein each housing is formed as an L-shaped configuration.

3. The electrical connector assembly as claimed in claim 2, wherein each supporting member comprises a body portion, an engaging portion extending from the body portion for engaging with the protrusion of the chip module and an inserting portion extending from a bottom surface of the body portion for inserting into channels defined on the bracket.

4. The electrical connector assembly as claimed in claim 1, wherein each housing defines a number of protrusions on outer sides for engaging with recesses defined on inner walls of the bracket.

5. An electrical connector assembly, comprising:

a bracket comprises a number of receiving sections;

a number of housings each having a plurality of terminals assembled therein and received in the receiving sections respectively;

a number of discrete supporting members having an engaging portion for interferingly engaging with a chip module;

wherein sidewalls of the chip module between the engaging portions indented inwardly for decreasing the surface needed to grind.

6. The electrical connector assembly comprising:

a unitary bracket dimensioned with a large area;

a plurality of housings each dimensioned with a small area while commonly complementarily arranged as an unit to be compliantly aligned with said large area; wherein said bracket including a plurality of elongated support bars in alignment with boundaries shared by two neighboring housings, and said plurality of housings are secured to said bracket so as to assure true positions of said housings without disassembling.

7. The electrical connector assembly as claimed 6, wherein the bracket essentially defines a frame structure so as to allow a bottom portion of each of said housings to be able to communicate with an exterior below the bracket.

8. An electrical connector assembly as claimed in claim 6, wherein securement between the bracket and the housing occurs on a periphery of said bracket.

9. The electrical connector assembly as claimed in claim 8, wherein a plurality of support members are fastened to at least one of said bracket and the corresponding housings to confine an electronic package receiving apace inside of said support members.

10. The electrical connector assembly as claimed in claim 9, wherein each of said support members defines a right angle configuration therein.

11. The electrical connector assembly as claimed in claim 10, wherein there are four housings and four support members to commonly define the electronic package receiving space.

* * * * *